US007934961B2

(12) United States Patent
Damodharan et al.

(10) Patent No.: US 7,934,961 B2
(45) Date of Patent: May 3, 2011

(54) LOW PROFILE CONTACT

(75) Inventors: Kasthuri Sankar Damodharan, Harrisburg, PA (US); Robert Wayne Walker, Harrisburg, PA (US)

(73) Assignee: Tyco Electronics Corporation, Berwyn, PA (US)

( * ) Notice: Subject to any disclaimer, the term of this patent is extended or adjusted under 35 U.S.C. 154(b) by 56 days.

(21) Appl. No.: 12/436,978

(22) Filed: May 7, 2009

(65) Prior Publication Data

US 2009/0311922 A1 Dec. 17, 2009

Related U.S. Application Data

(60) Provisional application No. 61/060,557, filed on Jun. 11, 2008.

(51) Int. Cl.
*H01R 4/48* (2006.01)

(52) U.S. Cl. ..... 439/862; 439/660

(58) Field of Classification Search ..... 439/862, 439/857, 660

See application file for complete search history.

(56) References Cited

U.S. PATENT DOCUMENTS

| | | | | |
|---|---|---|---|---|
| 263,132 | A * | 8/1882 | Edison | 191/29 R |
| 3,509,292 | A * | 4/1970 | Dehn | 191/49 |
| 3,575,576 | A * | 4/1971 | Harmsen | 191/32 |
| 4,420,207 | A | 12/1983 | Nishikawa | |
| 4,586,766 | A | 5/1986 | Hofmeister | |
| 4,709,974 | A | 12/1987 | Hawkins | |
| 4,938,264 | A | 7/1990 | Ferenczffy | |
| 5,158,471 | A * | 10/1992 | Fedder et al. | 439/80 |
| 5,259,769 | A | 11/1993 | Cruise et al. | |
| 5,428,197 | A | 6/1995 | McCurry et al. | |
| 5,544,274 | A | 8/1996 | Walker et al. | |
| 5,570,776 | A | 11/1996 | Buchholz et al. | |
| 5,876,223 | A * | 3/1999 | Kaneshige et al. | 439/108 |
| 6,065,912 | A | 5/2000 | Bosten et al. | |
| 6,181,032 | B1 | 1/2001 | Marshall et al. | |
| 6,237,698 | B1 | 5/2001 | Carrier et al. | |
| 6,261,036 | B1 | 7/2001 | Bosten et al. | |
| 6,496,381 | B1 | 12/2002 | Groeger | |
| 6,579,104 | B1 | 6/2003 | Bishop et al. | |
| 6,758,702 | B2 | 7/2004 | Johnescu | |
| 7,488,222 | B2 * | 2/2009 | Clark et al. | 439/825 |

FOREIGN PATENT DOCUMENTS

EP 1075906 A2 2/2001

OTHER PUBLICATIONS

Bosch; "Operating/Safety Instructions"; www.boschtools.com; Jun. 21, 2004.

* cited by examiner

*Primary Examiner* — Neil Abrams
*Assistant Examiner* — Phuong T Nguyen

(57) ABSTRACT

The invention provides a modular housing assembly system having a first housing assembly and second housing assembly. The first housing assembly has first contacts mounted thereon. The first contacts have elongated contact sections. The second housing assembly has second contacts mounted thereon. Each of the second contacts has more than one resilient contact sections spaced apart from each other along the longitudinal axis of the second contact. As the first housing assembly and the second housing assembly are moved into engagement, at least one resilient contact section of each of the second contacts are positioned in electrical engagement with the elongated contact sections of the first contacts. This configuration of the first contacts and second contacts allows the first contacts to make electrical engagement with second contacts of housing assembly or second contacts of housing assembly even though the housing assemblies have different configurations which causes the second contacts to be positioned at a different height than second contacts.

16 Claims, 8 Drawing Sheets

LOW PROFILE CONTACT

RELATED APPLICATION DATA

This application claims the benefit of U.S. Provisional Application Ser. No. 61/060,557, which was filed on Jun. 11, 2008, herein incorporated by reference.

FIELD OF THE INVENTION

The invention relates generally to a low profile contact that provides the electrical interface between two mateable housings. In particular, the contact is provided in a first housing and is configured to allow second housings of various heights to be mated thereto while still providing a secure and reliable electrical connection to the mating contacts provided on the second housing.

BACKGROUND OF THE INVENTION

Power tools of all shapes and sizes are known in the industry. Consumers purchase the particular tool to perform the specific function needed. These power tools can be costly. In addition, for the average consumer, many of the tools are used infrequently, thereby effectively adding to the cost of the tools.

In order to make a more cost effective tool, manufacturers are increasingly migrating to modular type solutions, in which the motor can be transferred from one tool to another. This allows the consumer to purchase the expensive motor one time. The motor assembly can be transferred between various tools. This allows the consumer to purchase one motor assembly and two base assemblies—one each for the plunge router and the fixed base router. As the motor assembly is the most expensive part of the router, the modular or combination approach benefits the consumer by reducing the price to own both tools.

However, to date these combination tools have had limited features when compared to the non-modular counterparts. In a stand alone, non-modular version of the plunge router, the integrated manufacture of the device allows the on/off switch to be position in the handle of the device, thereby providing the consumer with more operating control. In contrast, when the router is manufactured in modular form, it is difficult to have the on/off switch located in the handle, as no integrated electrical path can be included in the manufacture.

In an attempt to provide power to the handle to allow for switching, tools have been designed to allow the power to come directly into the handle with the plug from the modular motor being plugged into a receptacle in the handle. This is a cumbersome solution.

While the prior art has provided some ability to provide modular tools, it would be beneficial to have a modular system in which the motor assembly and base assembly have contacts which when mated together would provide the electrical pathway between the motor assembly and the base assembly to allow the base assembly to incorporate desired features therein. This type of contact system would also be beneficial in other applications in which two housings are mated together and which require an electrical pathway be provided therebetween.

SUMMARY OF THE INVENTION

The present invention provides a modular housing assembly system having a first housing assembly and second housing assembly. The first housing assembly has first contacts mounted thereon. The first contacts have elongated contact sections. The second housing assembly has second contacts mounted thereon. Each of the second contacts have more than one resilient contact sections spaced apart from each other along the longitudinal axis of the second contact. As the first housing assembly and the second housing assembly are moved into engagement, at least one resilient contact section of each of the second contacts are positioned in electrical engagement with the elongated contact sections of the first contact.

A cover with contact-receiving slots may be mounted on the first housing assembly proximate the first contacts. The longitudinal axis of the slots are spaced from and slightly offset from the longitudinal axis of the first contacts.

The second contacts have first beam portions and second beam portions, the second beam portions extend from the first beam portions at approximately ninety degrees. The resilient contact sections are resilient cantilever contact arms that are stamped and formed from the second beam portions. The second beam portions of the second contacts are positioned in the slots of the cover when the resilient contact arms are positioned in electrical engagement with the elongated contact sections of the first contacts.

The elongated contact sections are dimensioned to allow the elongated contact sections to make electrical connection to the second contacts even when the first housing assembly is mated to second housing assemblies of different heights.

The resilient contact sections are positioned at different heights along the longitudinal axis of the second beam portions to make electrical connection to the elongated contact sections of the first contacts even when the second housing assembly is mated to first housing assemblies of different heights.

The invention is also directed to a contact system for electrically connecting two assemblies when the assemblies are moved into engagement. The contact system has a first contact mounted on a first assembly housing and a second contact mounted on a second assembly housing. The first contact has an elongated contact section and the second contact has more than one resilient contact sections spaced apart from each other along the longitudinal axis of the second contact, whereby as the first assembly housing and the second assembly housing are moved into engagement, at least one resilient contact section of the second contact is positioned in electrical engagement with the elongated contact section of the first contact.

The resilient contact sections are resilient cantilever contact arms that are stamped and formed from the second beam portion, thereby providing the contacts with a low profile. In addition, as the resilient cantilever contact arms are stamped and formed directly from the second beam portion, the amount of material used to make the contact is reduced.

The invention is also directed to a modular housing assembly system having a first housing assembly and second housing assembly. The first housing assembly has first contacts mounted thereon. The first contacts have elongated contact sections. The second housing assembly has second contacts mounted thereon. Each of the second contacts have more than one resilient contact sections spaced apart from each other along the longitudinal axis of the second contact. At least one resilient contact section of each of the second contacts are positioned in electrical engagement with the elongated contact sections of the first contact as the first housing assembly and the second housing assembly are moved into engagement. The elongated contact sections of the first contacts are dimensioned to allow the elongated contact sections to make electrical connection to respective resilient contact sections of the second contacts even as the first housing assembly is mated to second housing assemblies of different heights.

Other features and advantages of the present invention will be apparent from the following more detailed description of the preferred embodiment, taken in conjunction with the accompanying drawings which illustrate, by way of example, the principles of the invention.

DETAILED DESCRIPTION OF THE INVENTION

Figure 1:
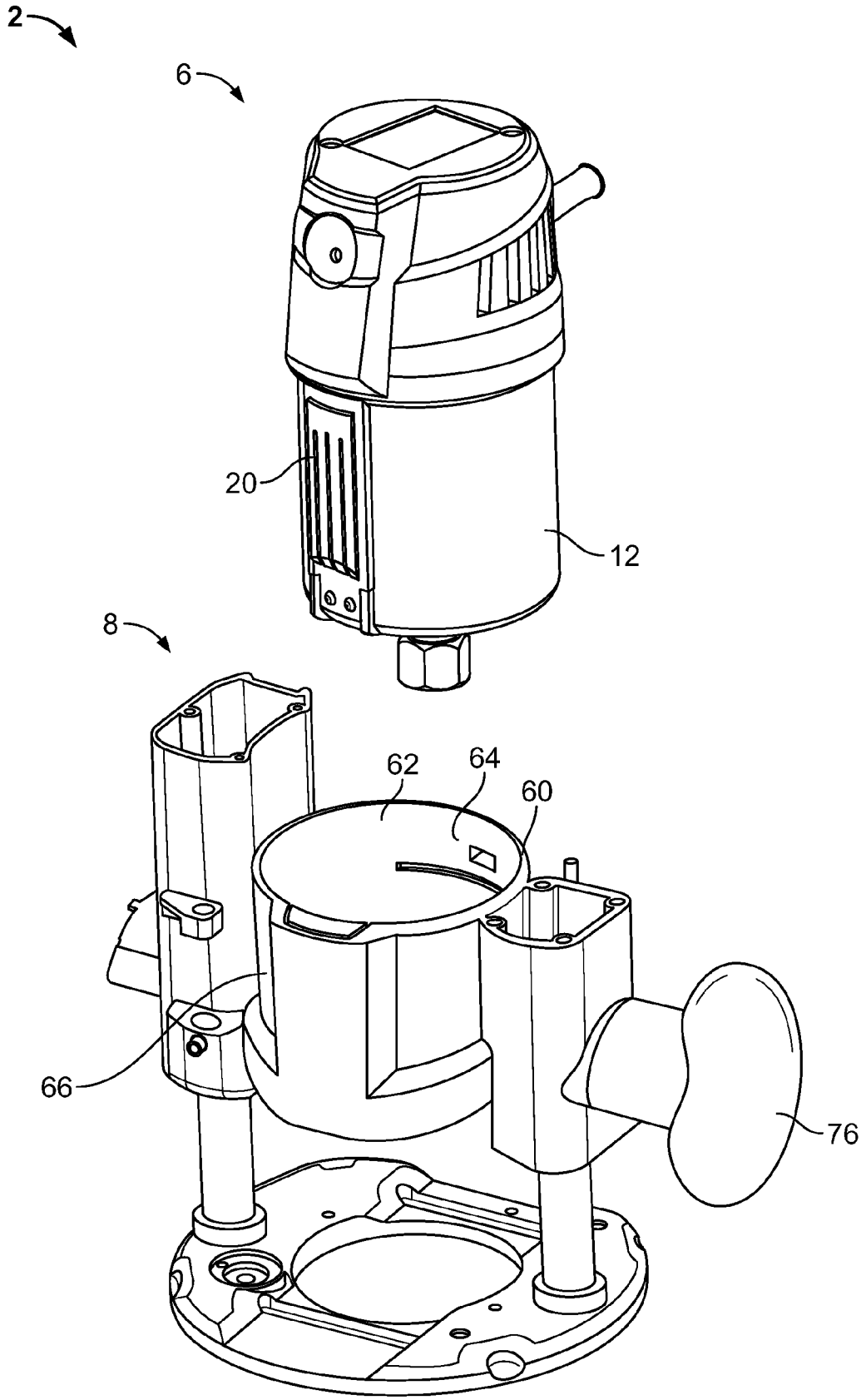
FIG. 1 is a three dimensional view of a plunge router with a motor assembly separated from a base assembly.
Figure 2:
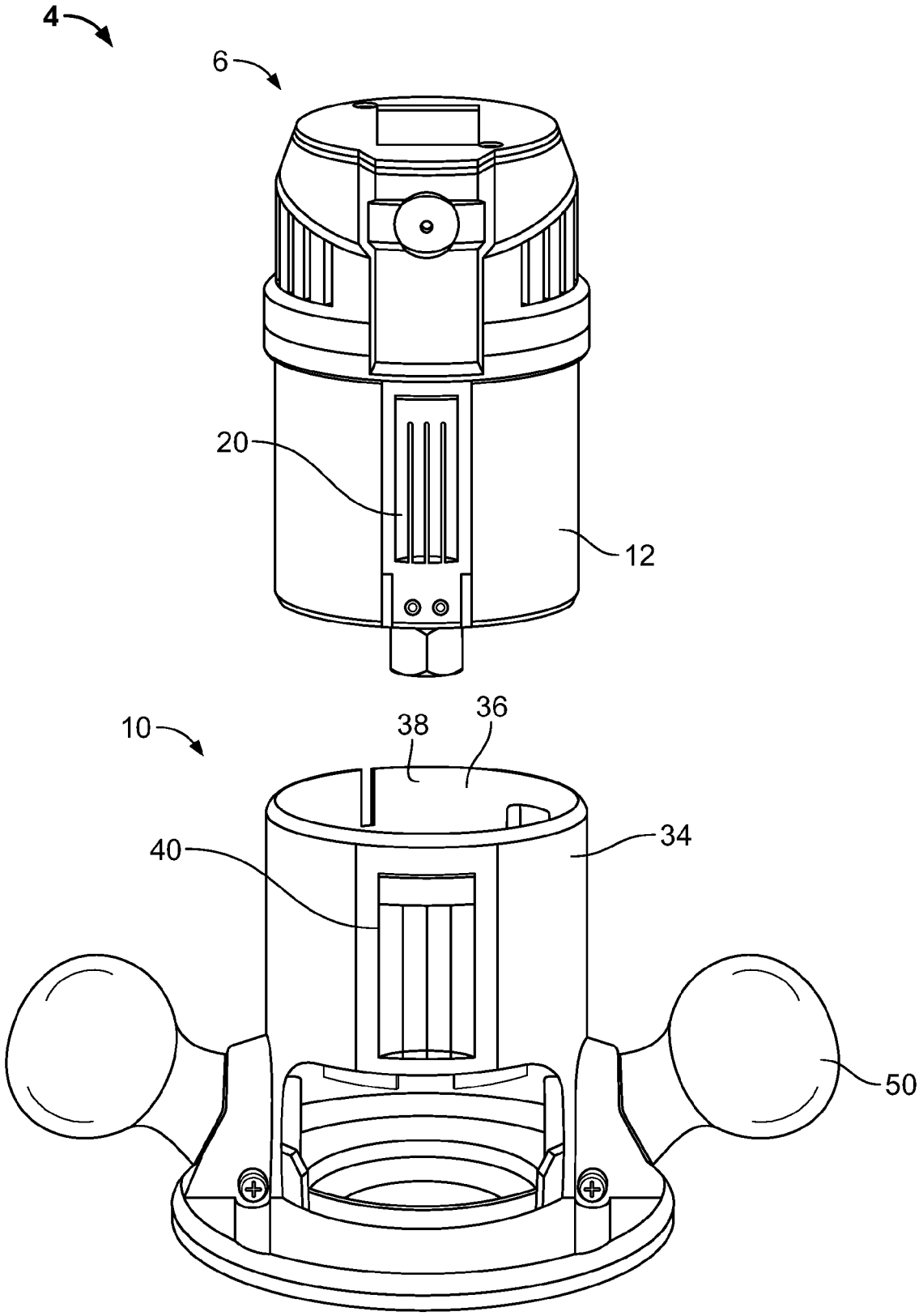
FIG. 2 is a three dimensional view of a fixed-base router with the motor assembly separated from a base assembly.

FIG. 1 depicts a plunge router 2 and FIG. 2 a fixed-based router 4. While the present invention is shown and described with the plunge router 2 and fixed base router 4, it will be appreciated that the particular tools are merely exemplary. As will be more fully described below, the invention can be used with any two housings which are mated together and which have an electrical interface therebetween.

As best shown in FIG. 1, plunge router 2 includes a motor assembly 6 and a base assembly 8. The motor assembly includes the motor and armature of the type generally known in the industry, similar to that shown in the parts description sheet for Bosch Plunge Router Model 0601619739. However, while the motor and armature are similar, the manner in which the motor is switched on and off is different in the present invention and will be more fully described below.

As best shown in FIG. 2, fixed base router 4 includes a motor assembly 6 and a base assembly 10. While the base assembly 10 is configured differently from base assembly 8 and performs a different function, the motor assembly 6 is the same for both the plunge router 2 and the fixed base router 4. This allows the consumer to purchase one motor assembly to be used with various base assemblies.

Figure 3:
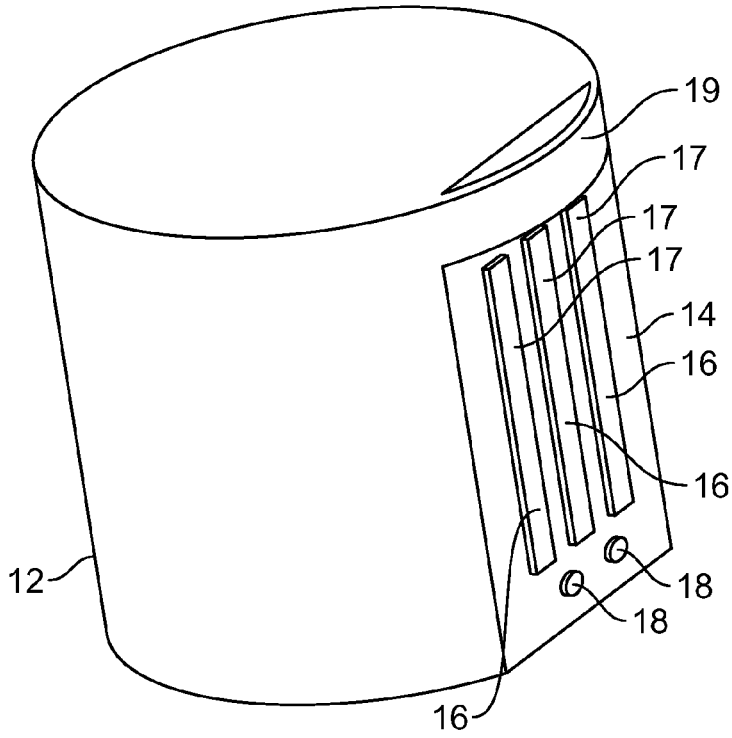
FIG. 3 is a schematic three-dimensional view of a portion of the motor assembly housing showing motor assembly contacts.

Referring to FIG. 3, the motor assembly 6 has a housing 12 made of plastic or other nonconductive material. The housing 12 has a flat contact mounting area 14. Motor assembly contacts 16 are mounted on the mounting area 14 in any conventional means. Contacts 16 may also be inserted or molded into the housing 12. In the embodiment shown, three contacts 16 are provided, but other applications may require more or less contacts. As shown in FIG. 3, contacts 16 have an elongate configuration with the longitudinal axis of the contacts 16 extending a direction parallel to the longitudinal axis of the housing 12. Each contact 16 has a contact surface 17 that faces away from the mounting area 14. Mounting openings 18 are provided in the mounting area 14 proximate the contacts 16. Wires 19, which are connected to the motor, extend through the housing 12 and are connected to the contacts 16 by use of soldering, standard plug terminals or other known methods.

Figure 4:
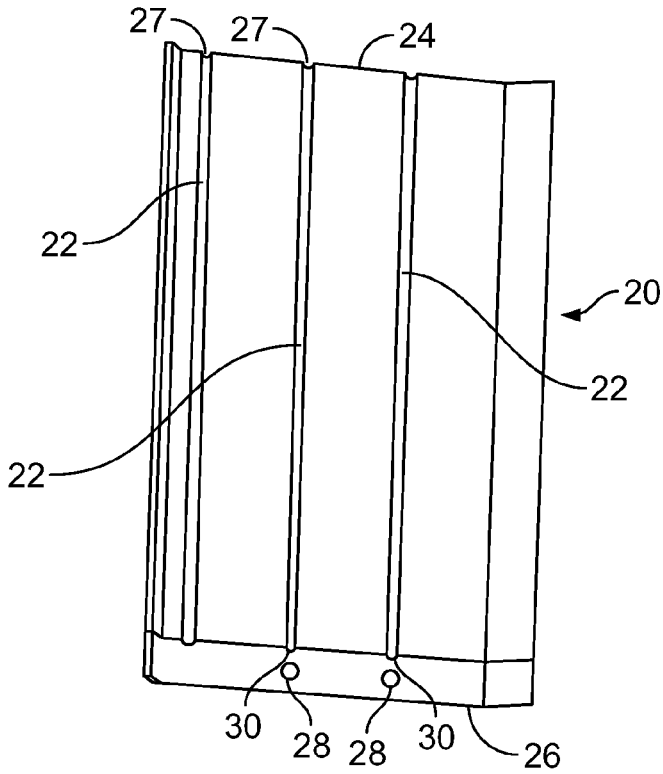
FIG. 4 is a three dimensional view of a removable track cover which is placed over the motor assembly contacts.

As shown in FIG. 4, a removable track cover 20 has contact receiving slots 22 positioned thereon. The slots 22 extend from a first edge surface 24 toward a second edge surface 26 of the cover 20. The slots 22 extend through the entire thickness of the cover 20. Slots 22 have a lead-in area 27 provided proximate the first edge surface 24. Mounting openings 28 are positioned in the cover 20. The mounting openings are positioned between ends 30 of the slots 22 and the second edge surface 26.

Figure 5:
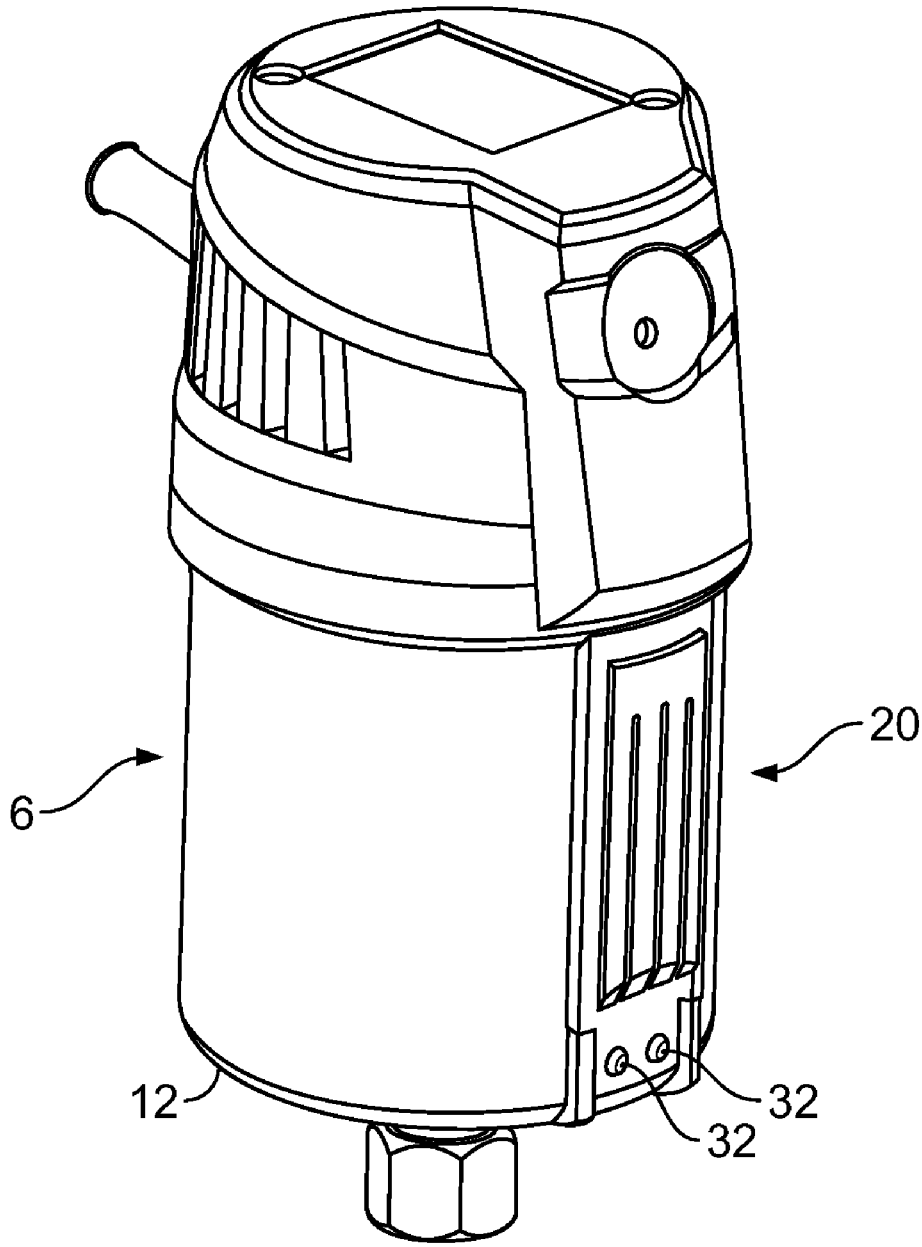
FIG. 5 is a three dimensional view of the removable track cover mounted on the motor housing assembly over the motor assembly contacts.
Figure 6:
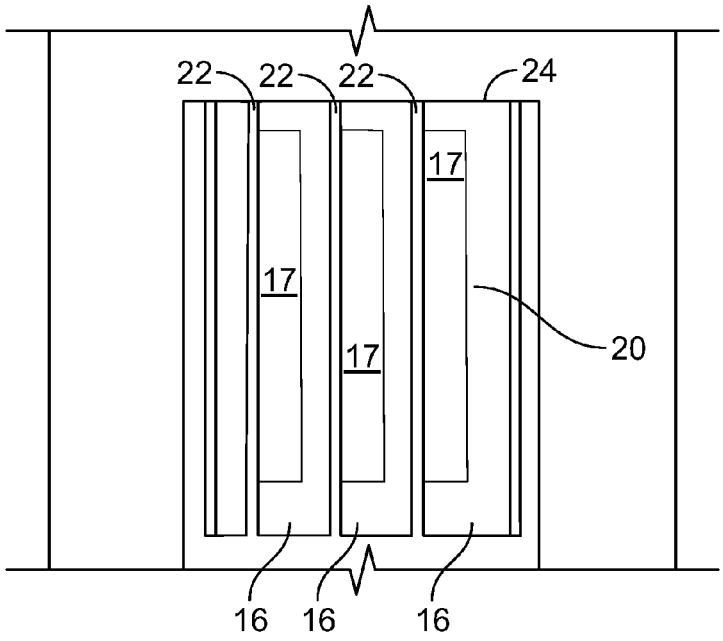
FIG. 6 is a schematic three-dimensional view of the removable track mounted in relation to the motor assembly contacts.

Removable track cover 20, as shown in FIG. 5, is mounted on the housing 12 by screws 32 positioned in openings 28 (FIG. 4) and 18 (FIG. 3). As best shown in FIG. 6, when cover 20 is properly mounted on housing 12, the longitudinal axis of the slots 22 are spaced from and slightly offset from the longitudinal axis of the contacts 16.

Figure 7:
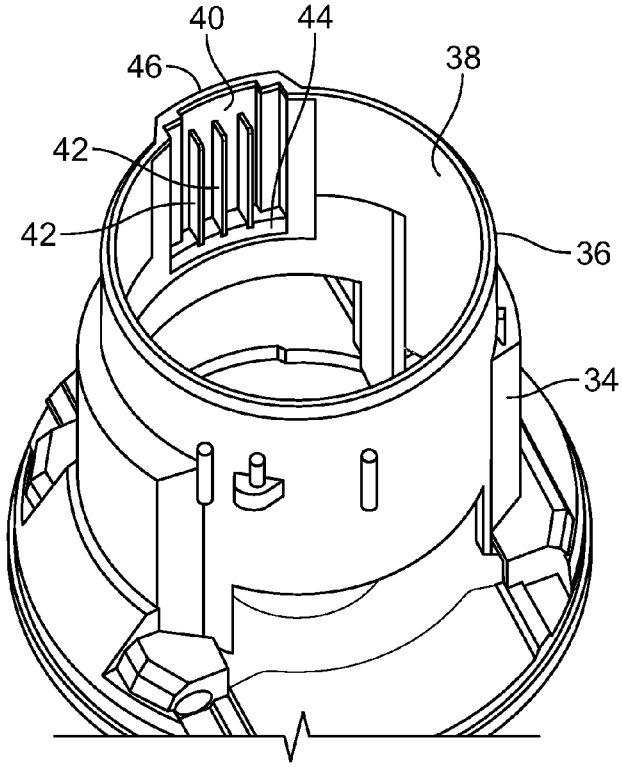
FIG. 7 is a three dimensional view of the base assembly of FIG. 2 showing base assembly contacts fixed thereto.
Figure 8:
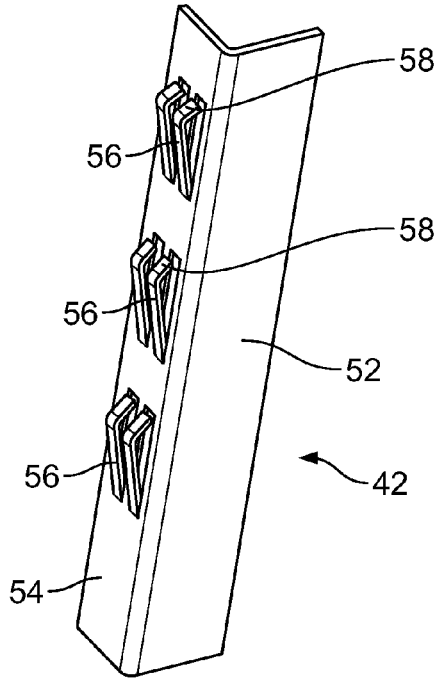
FIG. 8 is a three dimensional view of a single base assembly contact of FIG. 7 showing cantilever contact portions extending therefrom.

As shown in FIGS. 2 and 7 base assembly 10 has a housing 34. The housing 34 has a cylindrical portion 36 with an inside diameter dimensioned to receive the motor assembly 6 therein. The inside surface 38 of the cylindrical portion 36 has a contact receiving cavity 40 provided therein. Base assembly contacts 42 are positioned in the contact-receiving cavity 40 and extend from closed end 44 of the cavity toward the open end 46. In the embodiment shown, the contacts 42 are inserted or molded into the housing 34. The contacts 42 are provided in electrical engagement with a switch (not shown) provided on the handle 50 of the base assembly 10. As best shown in FIG. 8, each contact 42 has a first beam portion 52 and a second beam portion 54 that extends approximately ninety degrees to the first portion 52. Cantilever contact arms 56 are stamped and formed from the second beam portion 54. The cantilever contact arms 56 are positioned at different heights along the second beam portion 54. The contact arms 56 are formed so that the free ends 58 thereof extend from the contact arms 56 in a direction back toward the second beam portion 54.

In order to move the motor assembly 6 into the cylindrical portion 36 of the base assembly 10, the cover 20 must be positioned in alignment with the contact-receiving cavity 40. This alignment is required for mating of the motor assembly 6 to the base assembly 10, as the walls of the contact receiving cavity and the surfaces of the cover are dimensioned and configured to act as a keying mechanism, allowing only for the proper insertion of the motor assembly in the base assembly.

As the motor assembly 6 is inserted into the base assembly 10, the first beam portions 52 of contacts 42 engage the lead-in areas 27 of slots 22. The lead-in areas 27 guide the first beam portions 52 into slots 22, thereby adjusting for any slight misalignment or distortion of the contacts 42. With the first beam portions 52 properly aligned with slots 22, the insertion of the motor assembly into the base assembly continues. As this insertion continues, the first beam portions continue to slide into the slots 22. The cooperation of the first beam portions with the slots ensures that the second beam portions 54 will be aligned with the contacts 16. During insertion, the cantilever contact arms 56 of contacts 42 engage the contacts 16. The contact arms 56 are resiliently deformed to a stressed position, causing the contact arms 56 to exert a force on the contacts 16 as insertion continues. The combination of the force exerted and the movement of the contacts relative to each other allows for a wiping action, thereby facilitating a reliable electrical connection even if environments in which contaminates can accumulate on the surfaces of the contacts.

The insertion of the motor assembly 6 into the base assembly 10 is complete when the motor assembly is fully seated. In this position, the first beam portions 52 are fully inserted into slots 22. The ends 30 of slots 22 provide a positive stop for the first beam portions 52, thereby preventing the over insertion of contacts 42 relative to contacts 16.

Figure 9:
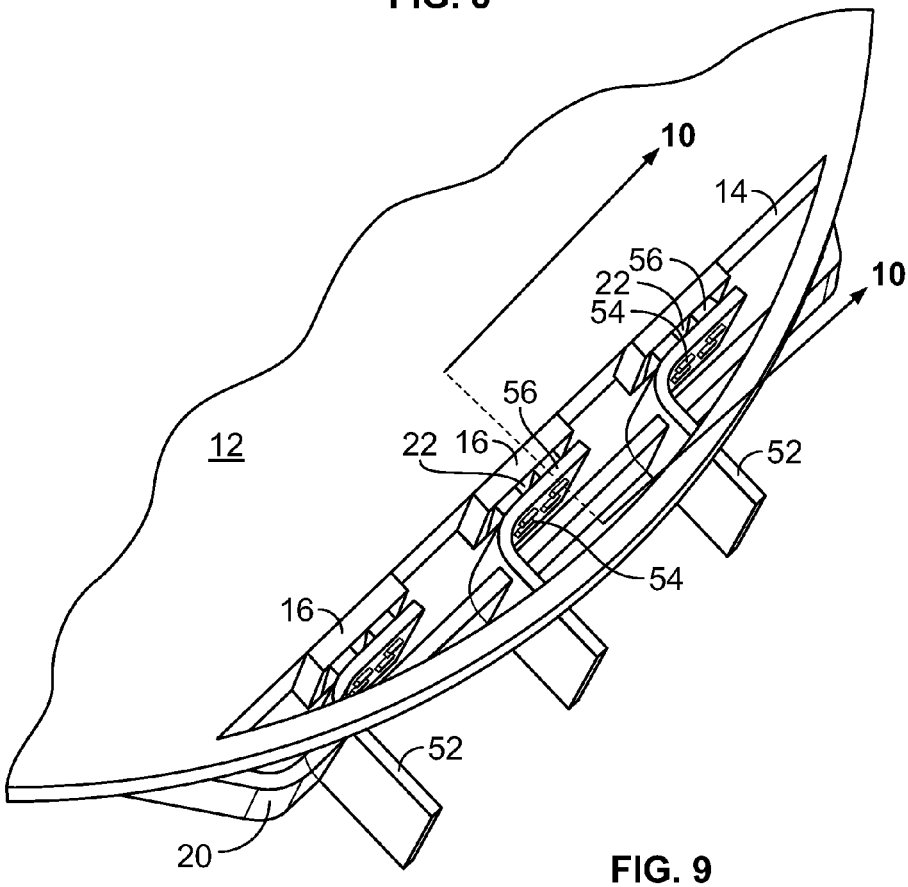
FIG. 9 is a top view perspective view of the motor housing showing the base assembly contacts mounted to the motor assembly contacts, for ease of understanding, the base assembly to which the base assembly contacts are mounted has been omitted from the drawing.
Figure 10:
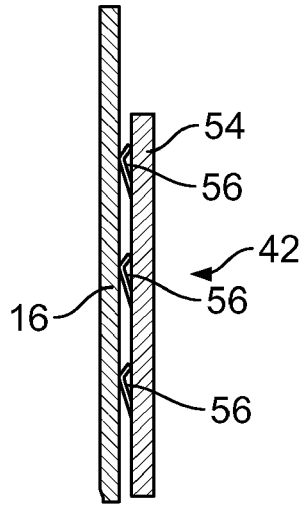
FIG. 10 is a cross sectional view taken along line 10-10 of FIG. 9 showing the base assembly contact mated to the motor assembly contact.

As shown in FIG. 9, when the motor assembly 6 is properly inserted into the base assembly 10, the first beam portions 52 of contacts 42 are positioned in slots 22. Second beam portions 54 are positioned between the cover 20 and the contact mating area 14, thereby allowing the cantilever contact arms 56 to be placed in electrical engagement with contacts 16, as is best shown in FIG. 10. As the contact arms 56 continue to be in a slightly depressed or resiliently deformed position, the electrical connection between the contacts 16 and 42 is maintained even when the motor vibrates during use, as the contact arms can be resiliently deformed to accommodate any relative movement of the contacts.

Figure 12:
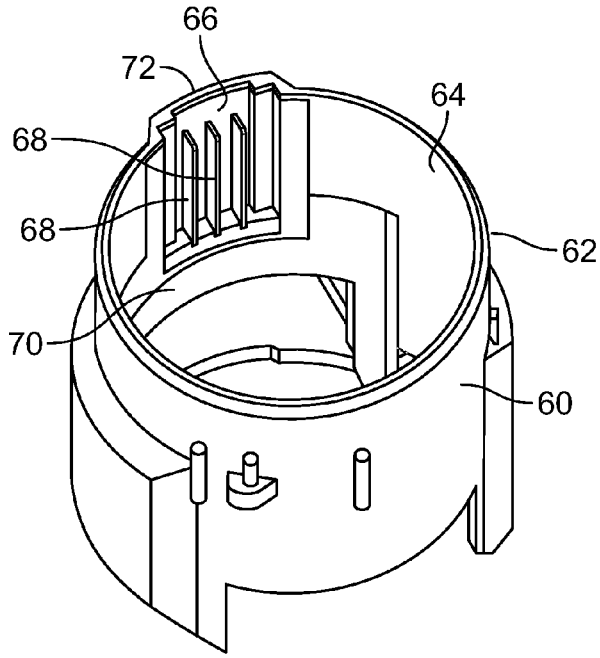
FIG. 12 is a three dimensional view of the base assembly of FIG. 1 showing base assembly contacts fixed thereto.
Figure 13:
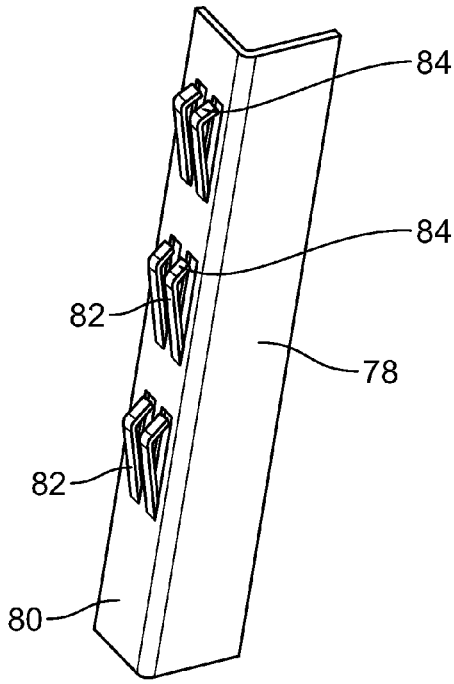
FIG. 13 is a three dimensional view of a single base assembly contact of FIG. 12 showing cantilever contact portions extending therefrom.

Referring to FIGS. 1 and 12, the use of the motor assembly 6 in conjunction with the plunge router 4 is similar to that described above. As shown in FIG. 12, base assembly 8 has a housing 60. The housing 60 has a cylindrical portion 62 with an inside diameter dimensioned to receive the motor assembly 6 therein. The inside surface 64 of the cylindrical portion 62 has a contact receiving cavity 66 provided therein. Base assembly contacts 68 are positioned in the contact-receiving cavity 66 and extend from closed end 70 of the cavity to the open end 72. In the embodiment shown, the contacts 68 are inserted or molded into the housing 60. The contacts 68 are provided in electrical engagement with a switch (not shown) provided on the handle 76 of the base assembly 8. As best shown in FIGS. 12 and 13, each contact 68 has a first beam portion 78 and a second beam portion 80 that extends approximately ninety degrees to the first portion 78. Cantilever contact arms 82 are stamped and formed from the second beam portion 80. The cantilever contact arms 82 are positioned at different heights along the second beam portion 80. The contact arms 82 are formed so that the free ends 84 thereof extend from the contact arms 82 in a direction back toward the second beam portion 80.

In order to move the motor assembly 6 into the cylindrical portion 62 of the base assembly 8, the cover 20 must be positioned in alignment with the contact-receiving cavity 66. This alignment is required for mating of the motor assembly 6 to the base assembly 8, as the walls of the contact receiving cavity and the surfaces of the cover are dimensioned and configured to act as a keying mechanism, allowing only for the proper insertion of the motor assembly in the base assembly.

As the motor assembly 6 is inserted into the base assembly 8, the first beam portions 78 of contacts 68 engage the lead-in areas 27 of slots 22. The lead-in areas 27 guide the first beam portions 78 into slots 22, thereby adjusting for any slight misalignment or distortion of the contacts 68. With the first beam portions 78 properly aligned with slots 22, the insertion of the motor assembly into the base assembly continues. As this insertion continues, the first beam portions 78 continue to slide into the slots 22. The cooperation of the first beam portions 78 with the slots ensures that the second beam portions 80 will be aligned with the contacts 16. During insertion, the cantilever contact arms 82 of contacts 68 engage the contacts 16. The contact arms 82 are resiliently deformed to a stressed position, causing the contact arms 82 to exert a force on the contacts 16 as insertion continues. The combination of the force exerted and the movement of the contacts relative to each other allows for a wiping action, thereby facilitating a reliable electrical connection even if environments in which contaminates can accumulate on the surfaces of the contacts.

The insertion of the motor assembly 6 into the base assembly 8 is complete when the motor assembly is fully seated. In this position, the first beam portions 78 are fully inserted into slots 22. In this embodiment, the first beam portions 52 are spaced from the ends 30 of slots 22.

When the motor assembly 6 is properly inserted into the base assembly 8, the first beam portions 78 of contacts 68 are positioned in slots 22. Second beam portions 80 are positioned between the cover 20 and the contact mating area 14, thereby allowing the cantilever contact arms 82 to be placed in electrical engagement with contacts 16. As the contact arms 82 continue to be in a slightly depressed or resiliently deformed position, the electrical connection between the contacts 16 and 68 is maintained even when the motor vibrates during use, as the contact arms can be resiliently deformed to accommodate any relative movement of the contacts.

In the embodiments described, the motor assembly 6 is identical and can be used with either base assembly 8 or base assembly 10. This allows the consumer to purchase only one motor any use the motor to power various tools. However, to accomplish the modular system, the contacts 16 of the motor assembly 6 are dimensioned to have a large mating area, thereby allowing the contacts 16 to make electrical engagement with contacts 42 of assembly 10 or contacts 68 of assembly 8 even though the housing 34 and housing 60 have different configurations which causes the contacts 42 to be positioned at a different height than contacts 68.

Figure 11:
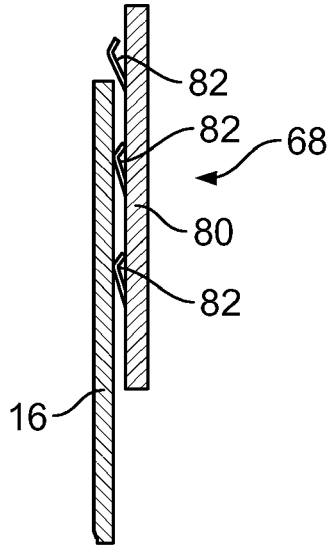
FIG. 11 is a cross sectional view similar to that of FIG. 10 showing the motor assembly contact mated to an alternate base assembly contact in which the base assembly is of a different height than the base assembly of FIG. 9.

In addition, to accommodate the modular design of the system, the contacts 42 and contacts 68 have multiple contact points positioned along the length of the longitudinal axis. Consequently, as shown in FIGS. 10 and 11, the entire contact 42 or contact 68 does not have to overlap contact 16 to provide a secure, reliable electrical connection therebetween. Providing any of the contact arms 56 or contact arms 82 is electrical engagement with the contacts 16 is sufficient to establish the need electrical connection.

All of the contacts 16, 42, 68 are configured to minimize the space required for the contacts and the space required to make the electrical connection. The amount of material required to manufacture the contacts is also minimized, as the contact arms 56 and 82 are stamped and formed directly from the material of the second beam portion.

While the invention has been described with reference to a preferred embodiment, it will be understood by those skilled in the art that various changes may be made and equivalents may be substituted for elements thereof without departing from the scope of the invention. In particular, the invention has been described with reference to power tools; however, the use of the contact system described can be used in many applications outside the field of power tools. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

The invention claimed is:

1. A contact system for electrically connecting two assemblies when the assemblies are moved into engagement, the contact system comprising a first contact provided on a first assembly housing, the first contact having an elongated contact section with a first longitudinal axis extending in a direction parallel to a first assembly longitudinal axis of the first assembly housing;

a cover positioned on the first assembly housing over the first contact, the cover having a contact receiving slot positioned thereon;

a second contact provided on a second assembly housing, the second contact having a first portion which extends through the contact receiving slot and a second portion which has a second longitudinal axis extending in a direction parallel to a second assembly longitudinal axis and parallel to the first longitudinal axis of the elongated contact section, the second portion having more than one resilient contact sections spaced apart from each other along the second longitudinal axis of the second portion;

whereby as the first assembly housing and the second assembly housing are moved into engagement, the first portion of the second contact is moved in the contact receiving slot to align the second portion of the second contact with the elongated contact section of the first contact, whereby at least one resilient contact section of the second portion of the second contact is moved partially across the elongated contact section to position the at least one resilient contact section of the first portion of the second contact in electrical engagement with the elongated contact section of the first contact.

2. The contact system as recited in claim 1 wherein the second portion of the second contact extends from the first portion of the second contact at approximately ninety degrees from the first portion.

3. The contact system as recited in claim 2 wherein the resilient contact sections are resilient cantilever contact arms that are stamped and formed from the second portion.

4. The contact system as recited in claim 3 wherein the resilient contact sections are positioned at different heights along the longitudinal axis of the second portion.

5. A modular housing assembly system comprising:

a first housing assembly including first contacts, the first contacts having elongated contact sections, each with a first longitudinal axis extending in a direction parallel to a first assembly longitudinal axis of the first housing assembly;

a cover positioned on the first housing assembly and extending over the first contact, the cover having contact receiving slots positioned thereon;

a second housing assembly including second contacts, the second contacts having first portions which extend through the contact receiving slots and second portions, each of the second portions having a second longitudinal axis extending in a direction parallel to a second assembly longitudinal axis and parallel to the first longitudinal axis of the elongated contact sections, the second portions having more than one resilient contact sections spaced apart from each other along the second longitudinal axis of the second portions of the second contacts;

whereby as the first housing assembly and the second housing assembly are moved into engagement, the first portions of the second contacts are moved in the contact receiving slots to align the second portions of the second contacts with the elongated contact sections of the first contacts, whereby at least one resilient contact section of each of the second portions of the second contacts are moved partially across the elongated contact sections to position the at least one resilient contact section of the first portions of the second contacts in electrical engagement with the elongated contact sections of the first contacts.

6. The modular housing assembly system as recited in claim 5 wherein the elongated contact sections are dimensioned to allow the elongated contact sections to make electrical connection to the first portion of the second contacts even as the first housing assembly is mated to second housing assemblies of different heights.

7. The modular housing assembly system as recited in claim 5 wherein the resilient contact sections are positioned at different heights along the longitudinal axis of the second portions to make electrical connection to the elongated contact sections of the first contacts even as the second housing assembly is mated to first housing assemblies of different heights.

8. The modular housing assembly system as recited in claim 5 wherein the first housing assembly has a flat contact mounting area on which the first contacts are mounted.

9. The modular housing assembly system as recited in claim 8 wherein the cover is mounted on the contact mounting area, the longitudinal axis of the contact receiving slots are spaced from and slightly offset from the first longitudinal axis of the first contacts.

10. The modular housing assembly system as recited in claim 9 wherein the second portions of the second contact extend from the first portions of the second contact at approximately ninety degrees from the first portions.

11. The modular housing assembly system as recited in claim 10 wherein the resilient contact sections are resilient cantilever contact arms which are stamped and formed from the second portions of the second contacts.

12. A modular housing assembly system comprising:

a first housing assembly including first contacts, the first contacts having elongated contact sections, each with a first longitudinal axis extending in a direction parallel to a first assembly longitudinal axis of the first housing assembly;

a cover positioned on the first housing assembly and extending over the first contact, the cover having contact receiving slots positioned thereon;

a second housing assembly including second contacts, the second contacts having first portions which extend through the contact receiving slots and second portions, each of the second portions having a second longitudinal axis extending in a direction parallel to a second assembly longitudinal axis and parallel to the first longitudinal axis of the elongated contact sections, the second portions having more than one resilient contact sections spaced apart from each other along the second longitudinal axis of the second portions of the second contacts;

at least one resilient contact section of each of the second portions of the second contacts is positioned in electrical engagement with the elongated contact section of a respective first contact as the first portions of the second contacts of the first housing assembly and the contact receiving slots of the second housing assembly are moved into engagement;

whereby the elongated contact sections of the first contacts are dimensioned to allow the elongated contact sections to make electrical connection to respective resilient contact sections of the second portions of the second contacts even as the first housing assembly is mated to second housing assemblies of different heights.

13. The modular housing assembly system as recited in claim 12 wherein the longitudinal axis of the contact receiving slots are spaced from and slightly offset from the first longitudinal axis of the elongated contact sections of the first contacts.

14. The modular housing assembly system as recited in claim 12 wherein the resilient contact sections are resilient cantilever contact arms which are stamped and formed from the second portions of the second contacts.

15. The modular housing assembly system as recited in claim 12 wherein the second portions of the second contacts extend from the first portions of the second contacts at approximately ninety degrees from the first portions.

16. The modular housing assembly system as recited in claim 15 wherein the resilient contact sections are resilient cantilever contact arms which are stamped and formed from the second beam portions.

* * * * *